US009217270B2

(12) United States Patent
Krajenke et al.

(10) Patent No.: US 9,217,270 B2
(45) Date of Patent: Dec. 22, 2015

(54) DECKLID HINGE SPRING INSTALLATION MECHANISM

(75) Inventors: Gary W. Krajenke, Warren, MI (US); Alvin N. Standard, Clarkston, MI (US); Edward L. Schulte, White Lake, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1112 days.

(21) Appl. No.: 13/267,182

(22) Filed: Oct. 6, 2011

(65) Prior Publication Data

US 2013/0086792 A1 Apr. 11, 2013

(51) Int. Cl.

| | |
|---|---|
| ***E05F 1/10*** | (2006.01) |
| ***E05F 1/14*** | (2006.01) |
| *E05F 1/12* | (2006.01) |

(52) U.S. Cl.

CPC ..... *E05F 1/1075* (2013.01); *E05F 1/14* (2013.01); *E05F 1/1215* (2013.01); *E05F 1/1238* (2013.01); *E05Y 2600/56* (2013.01); *E05Y 2900/546* (2013.01); *E05Y 2900/548* (2013.01); *Y10T 29/49947* (2015.01); *Y10T 403/32319* (2015.01)

(58) Field of Classification Search

CPC .. B60N 2/2252; B60N 2/2356; E05D 5/0207; E05D 5/062; E05D 7/0045; E05D 7/0423; E05D 7/04; E05D 7/123; E05F 1/1238; E05F 1/1215

USPC ..... 29/225, 525.01, 428; 296/76; 403/91; 16/238, 304, 382, 297, 223

See application file for complete search history.

(56) References Cited

U.S. PATENT DOCUMENTS

| | | | | |
|---|---|---|---|---|
| 2,272,230 | A * | 2/1942 | Van Voorhees | 16/306 |
| 4,012,807 | A * | 3/1977 | Kern | 16/288 |
| 7,350,845 | B1 * | 4/2008 | Duffy | 296/76 |
| 2014/0259528 | A1 * | 9/2014 | Duffy et al. | 16/239 |

FOREIGN PATENT DOCUMENTS

| | | | |
|---|---|---|---|
| DE | 20118961 | U1 | 3/2002 |
| JP | 2004100818 | A | 4/2004 |

* cited by examiner

*Primary Examiner* — Monica Carter
*Assistant Examiner* — Seahee Yoon

(57) ABSTRACT

A mechanism for installing a spring in a vehicle decklid includes a bracket supported on the decklid to rotate about an axis, including a leg extending radially from the axis, a spring secured to the bracket, a stop, and an attachment engaged with the bracket for rotating the bracket about the axis and extending the spring to an installed position where a force applied by the spring to the leg forces the bracket into contact with the stop, said contact preventing rotation of the bracket in a direction that extends the spring.

11 Claims, 3 Drawing Sheets

DECKLID HINGE SPRING INSTALLATION MECHANISM

BACKGROUND OF INVENTION

This invention relates generally to an apparatus for installing a decklid hinge spring using a tool, such as a pneumatic driver.

Extension springs are used to counterbalance deck lid hinges in motor vehicles. Current motor vehicles with extension springs require a sufficiently low magnitude of force to install the springs so that the operator can complete the installation without use of special tools. Conventionally one end of the spring is fixed to the deck lid and the opposite end is fixed to the vehicle's body.

But new vehicle applications, which require higher installation forces than operator limitations, often require complex, external point of installation tools and devices, such as hydraulic or pneumatic cylinders, to complete the installation.

Due to a desire to improve the counterbalance performance of deck lid hinges, springs having a larger spring constant are required. These springs produce higher spring forces in the deck lid assembly.

In such instances, special tools that hold the spring in an extended position can be used that allow for higher installation forces. These tools have to be closely reviewed to avoid potential for the spring to disengage during installation, since they are under high loads.

A need exists in the industry for a mechanism for installing a deck lid hinge spring in the vehicle such that the required installation forces are below the human factor criteria for spring installation.

SUMMARY OF INVENTION

A mechanism for installing a spring in a vehicle decklid includes a bracket supported on the decklid to rotate about an axis, including a leg extending radially from the axis, a spring secured to the bracket, a stop, and an attachment engaged with the bracket for rotating the bracket about the axis and extending the spring to an installed position where a force applied by the spring to the leg forces the bracket into contact with the stop, said contact preventing rotation of the bracket in a direction that extends the spring.

The invention comprehends a method for installing the spring in a vehicle deck lid, including securing a plate to the deck lid, using an attachment to secure a bracket to the plate for rotation about an axis, securing a spring to the bracket, and rotating the attachment and bracket about the axis and extending the spring to an installed position where a force applied by the spring forces the bracket into contact with a stop, said contact preventing rotation of the bracket in a direction that extends the spring.

The mechanism assists in extending a spring to a specific length minimizing installation forces produced by an operator in an assembly plant and eliminating complex tooling to tension the spring prior to installation.

Both the rotating bracket and base plate provide holes that align mutually to accept a fixing bolt, rivet, pin, or other attachment when the spring is in its installed position.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DETAILED DESCRIPTION

Figure 1:
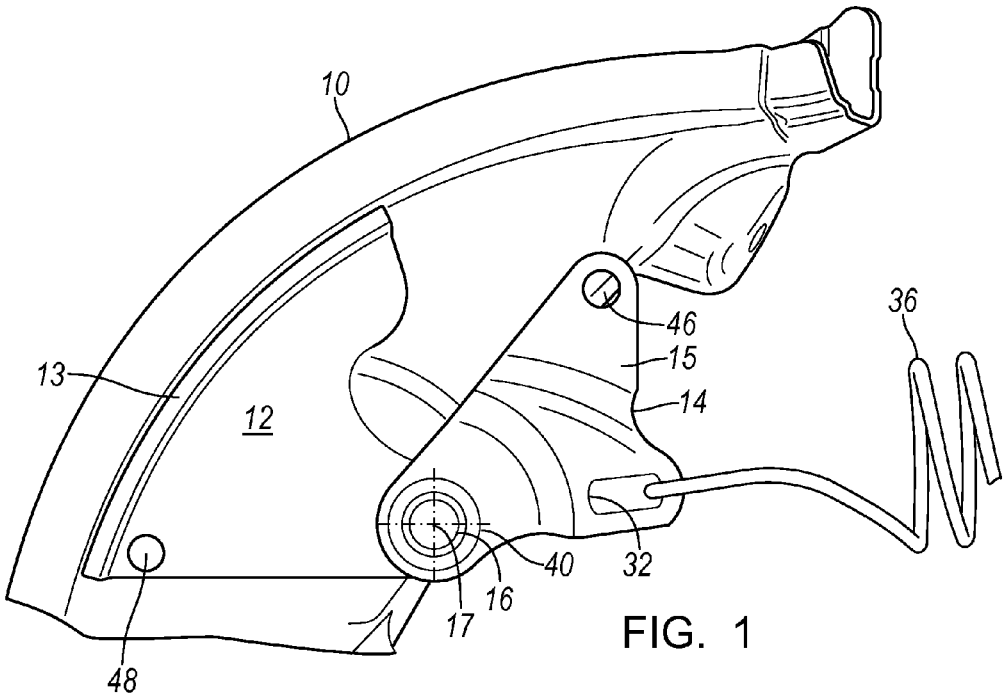
FIG. 1 is a side view of the spring installation mechanism shown in its neutral, unloaded position.

Referring now to the drawings, there is illustrated in FIG. 1 an open decklid 10 installed in a vehicle that is being assembled. Decklid 10 is secured to the vehicle body by a pivot joint (not shown), which permits the decklid to pivot between open and closed positions at the rear compartment of the vehicle.

A base plate 12, mechanically fastened to decklid 10 near a tail lamp housing, provides a flat surface and a flange 13 extending from the plane of the plate and along a portion of the periphery of the plate. A rotating bracket 14 is secured to the base plate by a bolt 16, which permits the bracket to rotate with respect to the base plate 12 about the axis 17 of the bolt 16. Bracket 14 includes a leg 15 that extends radially from the axis 17 of bolt 16.

Figure 2:
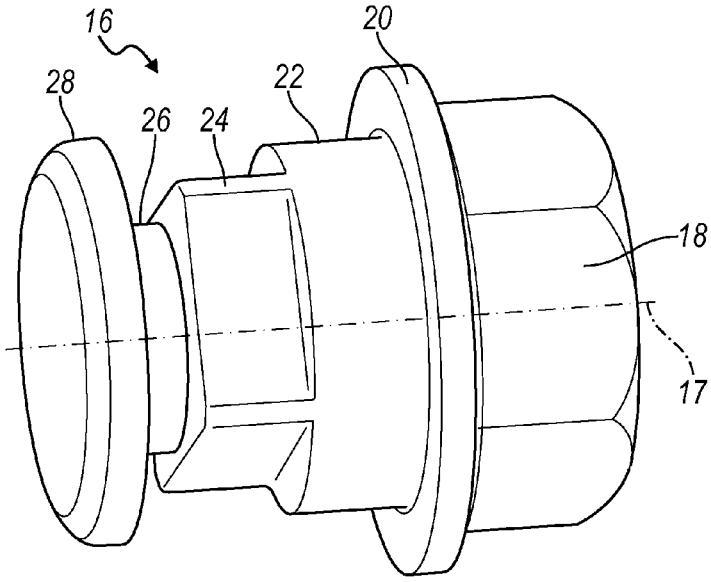
FIG. 2 is perspective view of a hex bolt.

As FIG. 2 shows, bolt 16 includes a hexagonal head 18, an annular shoulder 20, a cylindrical surface 22, a square shoulder 24, a cylindrical recess 26, and a rounded head 28.

Figure 3:
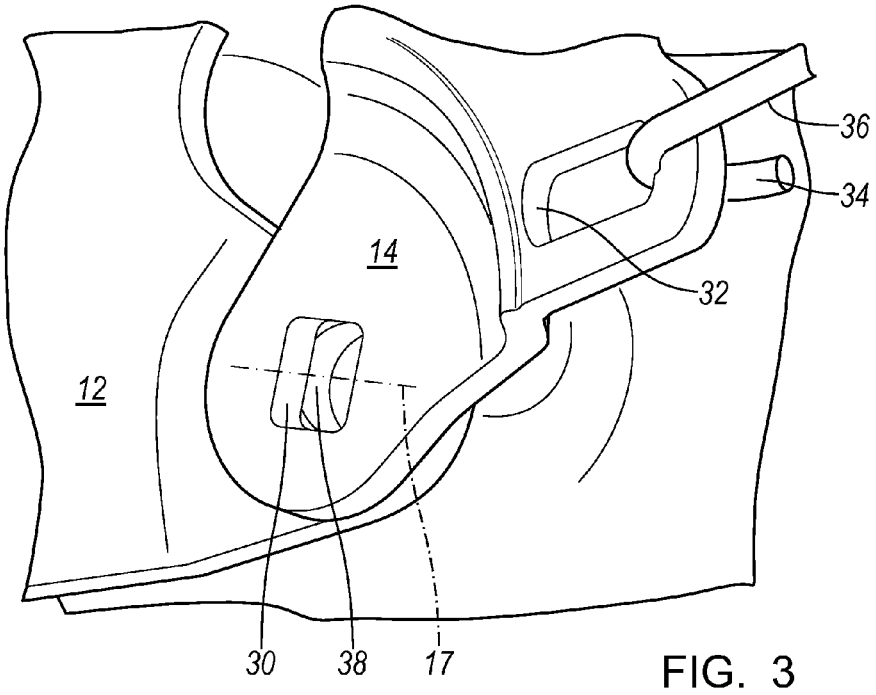
FIG. 3 is perspective view with the hex bolt and washer removed to show the rotating interlock feature of the rotating bracket.

As FIG. 3 shows, rotating bracket 14 is formed with a square hole 30, into which is fitted the square shoulder 24 of bolt 16 (shown in FIG. 2), and slotted hole 32, engaged with the hooked end 34 of a tension spring 36. The opposite end of the spring 36 is secured to a hinge strap, which is fixed to the vehicle's body. Base plate 12 is formed with a cylindrical surface 38, into which is fitted the cylindrical surface 22 of bolt 16 (shown in FIG. 2).

As FIGS. 1 and 2 show, a washer 40 is installed under the rounded head 28 of hex bolt 16, and the bolt is riveted to the bracket 14 and base plate 12.

Figure 4:
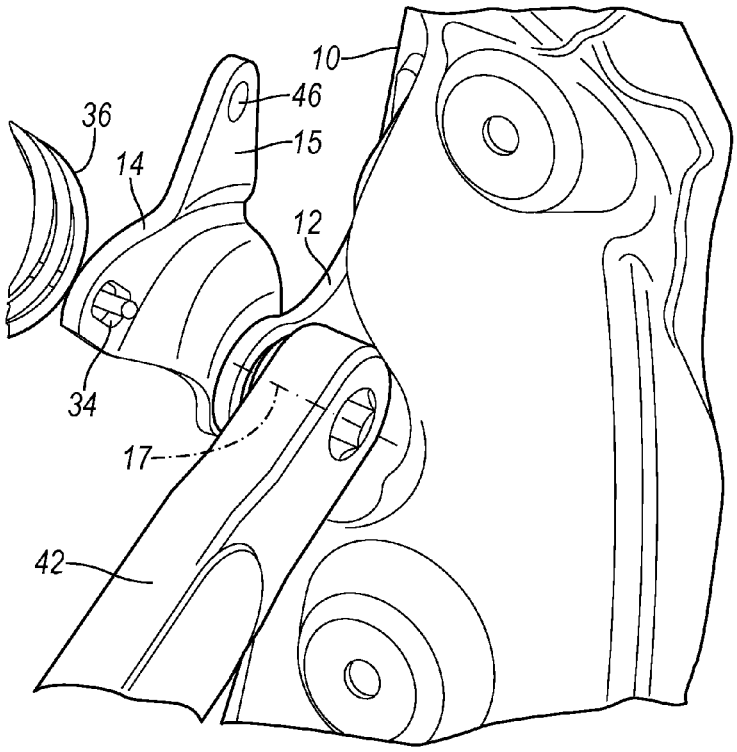
FIG. 4 is a perspective showing a tool engaged with the hex bolt.

In operation, FIG. 4 shows a tool 42, such as a pneumatic driver, engaged with the hex head 18 of bolt 16 (shown in FIGS. 1 and 2) at the underside of the base plate 12 and employed by an operator to rotate the rotating bracket 14 by rotating the bolt head 18. The force applied by the operator to the tool 42 while installing spring 36 to the bracket 14 is less than ergonomic limits for the operator due to its closer relationship to its unloaded position.

Figure 5:
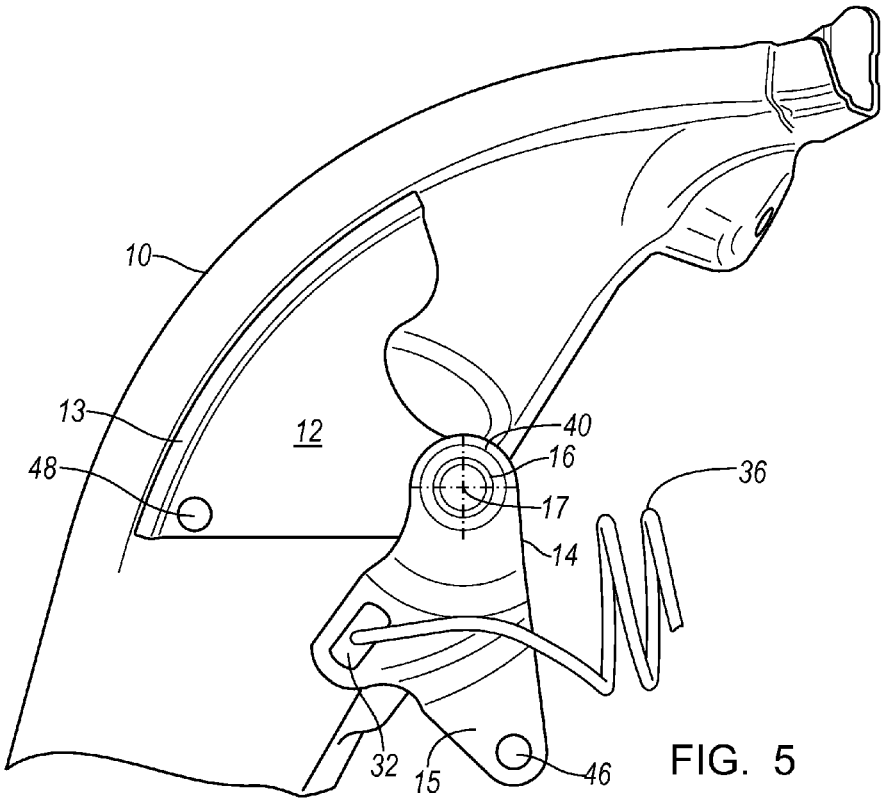
FIG. 5 is a side view of the spring installation mechanism shown in an intermediate position.
Figure 6:
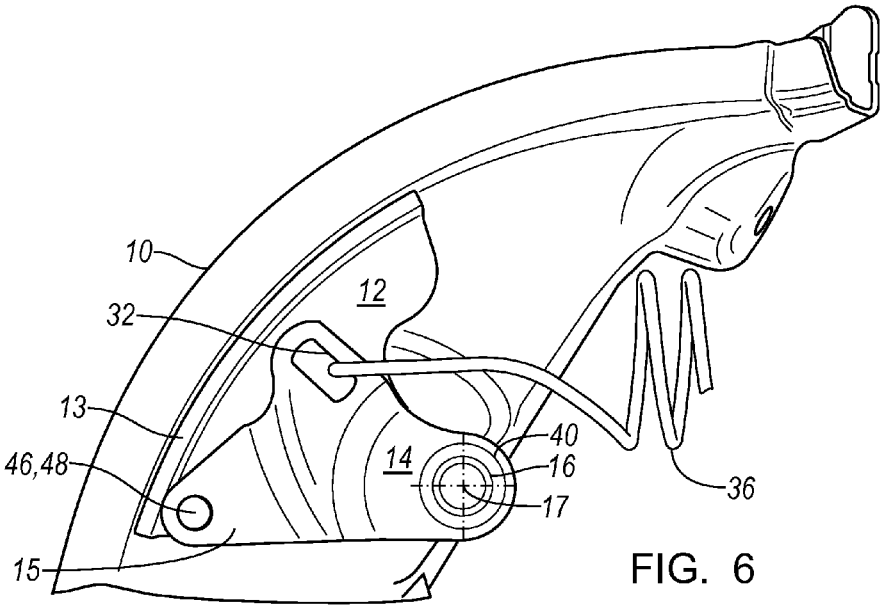
FIG. 6 is a side view of the spring installation mechanism shown in its installed position.

As the operator rotates tool 42, bolt 16 rotates 14 from the neutral position shown in FIG. 1 through an intermediate position shown in FIG. 5 to the installed position shown in FIG. 6. During installation of spring 36, bracket 14 pivots greater than 180 degrees past the center of bolt 16. In the installed position, the spring force applies to bracket 14 a moment about the axis of bolt 16 tending to pivot bracket 14 clockwise. That moment is reacted by a moment produced by a force applied at the point of contact between leg 15 of bracket 14 and flange 13 (also referred to as a stop or stop surface) of base plate 12, the reaction moment tending to rotate the bracket counterclockwise.

When bracket 14 is rotated to the installed position, a hole 46 in leg 15 aligns with a hole 48 in base plate 12, such that a bolt or pin inserted into the aligned holes 46, 48 prevents further rotation of the bracket relative to the base plate.

While certain embodiments of the present invention have been described in detail, those familiar with the art to which this invention relates will recognize various alternative designs and embodiments for practicing the invention as defined by the following claims.

What is claimed is:

1. A mechanism for installing a tension spring in a vehicle decklid, comprising:

a bracket supported on the decklid to rotate about an axis, including a leg extending radially from the axis;

the spring secured to the bracket;

a stop; and an attachment rotationally fixed relative to the bracket for rotating the bracket about the axis and extending the tension spring to an installed position where a force applied by the tension spring to the leg forces the bracket into contact with the stop, the contact preventing rotation of the bracket in a direction that retracts the tension spring; and wherein the attachment further includes: a hexagonal head, a square shoulder engaging a non-circular hole in the bracket for transmitting torque between the attachment and the bracket, and a second head located at an end of the attachment opposite the hexagonal head.

2. The mechanism of claim 1, further comprising a tool rotationally fixable to the attachment for rotating the attachment and the attachment in turn causing rotation of the bracket about the axis.

3. The mechanism of claim 1, wherein the axis is in a fixed position relative to the decklid.

4. The mechanism of claim 1, wherein:

the bracket includes a slotted hole spaced from the axis; and the tension spring includes a hooked end engaged with the slotted hole.

5. A mechanism for installing a tension spring in a vehicle decklid, comprising:

a plate secured to the decklid, including a stop surface and a flat surface;

a bracket supported on the flat surface for rotation about an axis, including a leg extending radially from the axis;

the tension spring secured to the bracket; and an attachment secured to the plate to allow for rotation of the attachment relative to the plate and rotationally fixed relative to the bracket for rotating the bracket about the axis and extending the tension spring to an installed position where a force applied by the tension spring to the leg forces the bracket into contact with the stop surface, the contact preventing rotation of the bracket in a direction that retracts the spring; and wherein: the bracket leg is formed with a first hole spaced from the axis; and the plate is formed with a second hole spaced from the axis, the holes being aligned mutually when the bracket is rotated to the installed position.

6. The mechanism of claim 5, further comprising a tool rotationally fixable to the attachment between the decklid and the plate for engaging the attachment and rotating the attachment and the bracket about the axis.

7. The mechanism of claim 5, wherein the axis is in a fixed position relative to the decklid.

8. The mechanism of claim 5, wherein the attachment further includes:

a hexagonal head;

a square shoulder engaging a non-circular hole in the bracket for transmitting torque between the attachment and the bracket; and a second head located at an end of the attachment opposite the hexagonal head.

9. The mechanism of claim 5, wherein:

the bracket includes a slotted hole spaced from the axis; and the tension spring includes a hooked end engaged with the slotted hole.

10. A method for installing a tension spring in a vehicle deck lid, comprising:

fixing a plate to the deck lid, the plate having a stop;

using an attachment to secure a bracket to the plate for rotation of the attachment and the bracket about an axis, the axis in a fixed position relative to the deck lid, the attachment being rotationally fixed relative to the bracket;

securing the tension spring to the bracket;

rotating the attachment and bracket about the axis to extend the tension spring to an installed position where a force applied by the tension spring forces the bracket into contact with the stop, said contact preventing rotation of the bracket in a direction that retracts the tension spring; and rotating the bracket about the axis such that a first hole, spaced from the axis, formed in a bracket leg becomes aligned mutually with a second hole, spaced from the axis, formed in the plate.

11. A method for installing a tension spring in a vehicle deck lid, comprising:

fixing a plate to the deck lid, the plate having a stop;

using an attachment to secure a bracket to the plate for rotation of the attachment and the bracket about an axis, the axis in a fixed position relative to the deck lid, the attachment being rotationally fixed relative to the bracket;

securing the tension spring to the bracket;

rotating the attachment and bracket about the axis to extend the tension spring to an installed position where a force applied by the tension spring forces the bracket into contact with the stop, said contact preventing rotation of the bracket in a direction that retracts the tension spring; and wherein the bracket, after securing the tension spring, is rotated greater than 180 degrees about the axis to the installed position.

* * * * *